US008870670B2

(12) United States Patent
Kordecki

(10) Patent No.: US 8,870,670 B2
(45) Date of Patent: Oct. 28, 2014

(54) BOWLING FINGERS PERIPHERAL AID

(71) Applicant: John R. Kordecki, Arlington Heights, IL (US)

(72) Inventor: John R. Kordecki, Arlington Heights, IL (US)

( * ) Notice: Subject to any disclaimer, the term of this patent is extended or adjusted under 35 U.S.C. 154(b) by 0 days.

(21) Appl. No.: 13/851,567

(22) Filed: Mar. 27, 2013

(65) Prior Publication Data

US 2013/0260907 A1 Oct. 3, 2013

Related U.S. Application Data

(60) Provisional application No. 61/685,914, filed on Mar. 27, 2012.

(51) Int. Cl.

| | |
|---|---|
| ***A41D 19/00*** | (2006.01) |
| ***A63B 71/04*** | (2006.01) |
| ***A41D 13/08*** | (2006.01) |
| ***A63B 71/14*** | (2006.01) |
| *A63B 69/00* | (2006.01) |

(52) U.S. Cl.

CPC ..... *A63B 71/04* (2013.01); *A63B 2225/09* (2013.01); *A63B 2069/0008* (2013.01); *A63B 69/0046* (2013.01); *A63B 69/0024* (2013.01); *A41D 13/087* (2013.01); *A63B 71/148* (2013.01)

USPC ..... 473/61; 2/161.1

(58) Field of Classification Search

USPC ..... 473/61; 2/21, 161.1, 163; 602/22

See application file for complete search history.

(56) References Cited

U.S. PATENT DOCUMENTS

| | | | | |
|---|---|---|---|---|
| 3,011,171 | A * | 12/1961 | Pell | 2/21 |
| 3,421,761 | A * | 1/1969 | Grant | 473/61 |
| 4,273,330 | A * | 6/1981 | Buneta | 473/61 |
| 4,441,711 | A | 4/1984 | Dubar | |
| 4,531,735 | A * | 7/1985 | Kovacs | 473/61 |
| 5,758,365 | A * | 6/1998 | Steeley | 2/161.1 |
| 5,906,546 | A | 5/1999 | Albert | |
| 5,991,918 | A * | 11/1999 | Choate | 2/21 |
| 7,682,261 | B1 * | 3/2010 | Addington et al. | 473/61 |
| 7,895,671 | B2 * | 3/2011 | Salomon | 2/161.2 |
| 8,458,817 | B1 * | 6/2013 | Babb | 2/163 |
| 2006/0205526 | A1 * | 9/2006 | Whitehead et al. | 473/59 |
| 2009/0275418 | A1 | 11/2009 | Whitehead, II et al. | |
| 2013/0227755 | A1 * | 9/2013 | Bisaillon | 2/20 |

OTHER PUBLICATIONS

PCT International Search Report and Written Opinion for International Application No. PCT/US2013/034105, dated Jul. 31, 2013.

* cited by examiner

*Primary Examiner* — William Pierce

(74) *Attorney, Agent, or Firm* — Bishop Diehl & Lee, Ltd.

(57) ABSTRACT

An aid for protecting and/or supporting a user's finger(s) or hand during an activity is described. The aid is particularly suited for activities involving repeated grasping which causes strain to the finger(s) and/or hand. The aid may be of a one-piece or two-piece design with features which allow adjustment to accommodate various finger and hand sizes. Generally speaking, the aid includes a finger collar which is placed about a user's fingers, and an extended support which combined with the collar holds the user's finger(s) in a particular curved state.

15 Claims, 11 Drawing Sheets

BOWLING FINGERS PERIPHERAL AID

RELATED APPLICATION

The present application claims the filing priority of U.S. Provisional Application No. 61/685,914, titled "Bowling Fingers Peripheral Aid" and filed Mar. 27, 2012. The '914 application is also hereby incorporated by reference.

TECHNICAL FIELD OF THE INVENTION

The present device relates to a bowling aid. More specifically, the device relates to a finger grip aid for bowlers.

BACKGROUND OF THE INVENTION

Bowling is a hobby/sport enjoyed by millions of people around the world with demographics including amateurs, such as occasional participants and organized league bowlers, as well as tournament and professional level bowlers. The largest segment of the bowling population is by far the amateur bowlers. To accommodate the many skill levels of bowlers, even amongst amateurs, bowling balls are designed to best suit a person's skill level or proficiency.

Bowling balls are also drilled with different finger hole layouts and positioning to match an appropriate skill level. The three types of bowling ball finger hole layouts are (1) a conventional grip, most commonly used for beginners and occasional bowlers and applied to "house" supplied inexpensive bowling alley balls, (2) the semi-fingertip grip, not typically used by many bowlers, and, (3) the fingertip grip, most used by amateur league bowlers, tournament and pro bowlers. The present device will appeal to and aid the third group, which is also the largest segment of bowlers, as they prefer the fingertip grip.

The fingertip grip requires more hand strength, but allows the bowler to release the ball cleaner and with more lift, giving the bowler more control in how the ball rotates after it is released. Bowlers that throw a hook ball typically use the finger tip grip.

Most popularly, the two fingers inserted into a fingertip ball are the middle and ring fingers, but only to the first (outermost) finger joint. From a mechanical or physical standpoint, upon final release of the bowling ball, the weight of the ball is leveraged against the user's two fingertips creates a potential for strain or injury in a number of the hand areas. This is a significant problem for competitive bowlers. The present device, properly used, will significantly reduce the chance of finger, tendon and wrist injury, as well as enhance the bowler's overall experience.

In the past, bowlers have been known to tape the adjacent pinkie finger to the ring finger to provide greater support and reduce strain on the finger and hand. Further, there are a number of devices, braces, gloves, and finger inserts available to a bowler who is attempting to achieve comfort and create a consistent hook shot. Such bowling aids can often be expensive and cumbersome when applied to the hand or wrist. The need exists for a bowling aid which is inexpensive, far less obtrusive and can be slipped on and off without the need to secure with any type of strap or mechanical clasp. Additionally, a device which may be used in conjunction with other types of bowling aids is also desired.

From a physical standpoint, when the bowling aid is used proactively on a regular basis, it dramatically reduces the conditions for a bowling finger, wrist strain or injury to occur. If however, a bowler experienced this type of injury prior to ever wearing the bowler's aid, the bowler could help speed up his recovery time by using this invention. Although the predominant user of the disclosed device will be bowlers, it may also be used to provide relief, comfort and protection for participants in other sports or activities or when a hand/finger injury has already occurred. For example, the device may be used to protect a baseball batter's fingers while holding a bat, a hockey player's fingers while gripping a stick, or most any other similar application. In essence, the disclosed device is not only a device to improve one's bowling skill, but it may also be used to help nurse a player back to hand and wrist health by stabilizing and strengthening the fingers and tendons typically used when participating in sports like bowling.

Until the device of the present application, these and other problems in the prior art went either unnoticed or unsolved by those skilled in the art. The present device provides a simple, adjustable, compatible, and protective aid for the hand and/or fingers without sacrificing comfort or affordability.

SUMMARY OF THE INVENTION

There is disclosed herein a bowling aid which avoids the disadvantages of prior devices while affording additional structural and operating advantages. The several embodiments of the device can be readily placed onto, and removed from at least one and preferably two fingers of a user to support the fingers during an activity, such as bowling.

Generally speaking, the device comprises a finger collar and a finger support which extends from the collar. The components may be molded as a single-piece embodiment, or as separate components to be assembled.

In an embodiment, the collar defines a periphery of an opening for insertion of a plurality of a user's fingers and the rigid extended support curves in a direction transverse to a line through a plane of the periphery such that the fingers when properly placed into the collar are held in a slightly curved "grip-like" manner.

In an embodiment, an adjustment control is used for changing a dimension of the opening defined by the periphery. This allows the device to be manufactured in limited sizes while still accommodating a greater scope of users having different finger widths.

Preferably, the adjustment control comprises a threaded shaft traversing the opening and a threaded receptacle positioned within the collar and engaged with the threaded shaft. Turning the threaded shaft, via any known head design (e.g., slotted, phillips, hex, star), alters a height of the opening to accommodate greater and lesser finger circumferences.

The embodiments may have a periphery of the opening which accommodates no more than two fingers. The device may include a collar and support molded as one-piece or, alternatively, as two assembled parts. In the latter embodiment, the parts may be replaced as they become worn or damaged.

In other embodiments, the finger collar may define two separate and adjacent openings, or, alternatively, it may define two joined and adjacent openings. Likewise, separate and adjacent supports having a lengths may be substantially equal, or, alternatively, the length of one support may be substantially greater than the length of the other support.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings, embodiments thereof, from an inspection of which, when considered in connection with the following description, the subject matter sought to be protected, its construction and operation, and many of its advantages should be readily understood and appreciated.

DETAILED DESCRIPTION OF THE INVENTION

Figure 1:
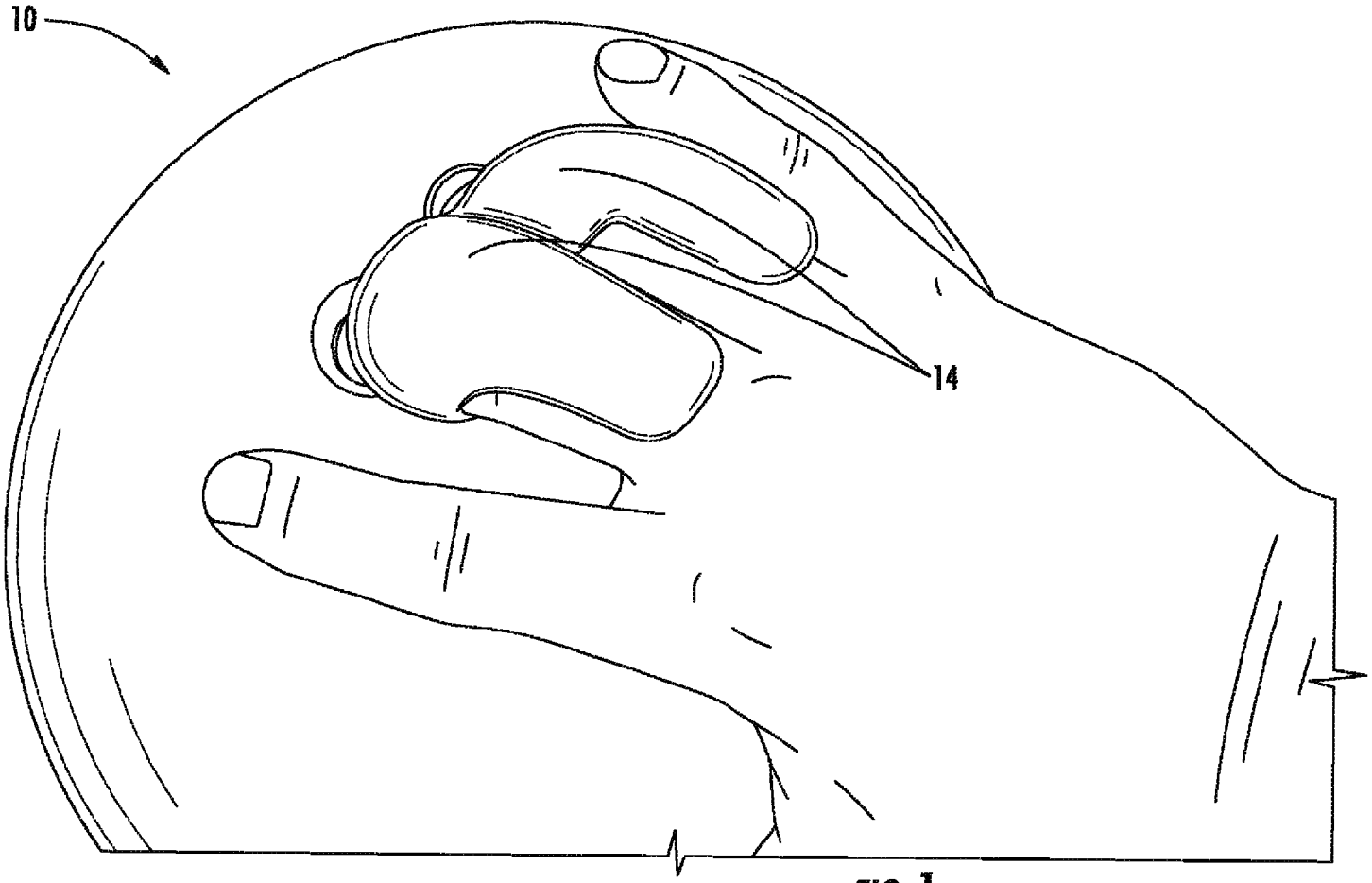
FIG. 1 is a perspective view of a first embodiment of the present device shown in use to assist gripping a bowling ball.

While this invention is susceptible of embodiments in many different forms, there is shown in the drawings and will herein be described in detail at least one preferred embodiment of the invention with the understanding that the present disclosure is to be considered as an exemplification of the principles of the invention and is not intended to limit the broad aspect of the invention to any of the specific embodiments illustrated.

Referring to FIGS. 1-14, there are illustrated several embodiments of a finger aid device, generally designated by the numeral 10. In the drawing figures the particular illustrated device 10 is for a bowler. In fact, while all the embodiments illustrated are directed to an aid for bowling fingers, particularly for a finger grip bowler, it should be understood that the principles of the invention can be more broadly applied to a finger support or protective aid for many activities, including work activities using hand tools (e.g., shovels, rakes, etc.) and sports, such as baseball, hockey and the like. As long as the activity involves grasping or a similar hand or finger action, the device 10 may be beneficial.

Generally speaking, the device 10 is comprised of a finger collar 12 and at least one extended support 14. The collar 12 can be configured in a number of different ways, all of which include at least one opening 16 having a periphery 18 defined by the collar 12 and allow a user to secure the device 10 to at least one finger by insertion into the opening 16. Similarly, the extended support 14, which connects to the collar 12, may also be configured in numerous ways. A single support may extend across multiple fingers or individual and adjacent extending supports may be used. Numerous of these configurations are illustrated in the drawings and explained below.

Figure 2:
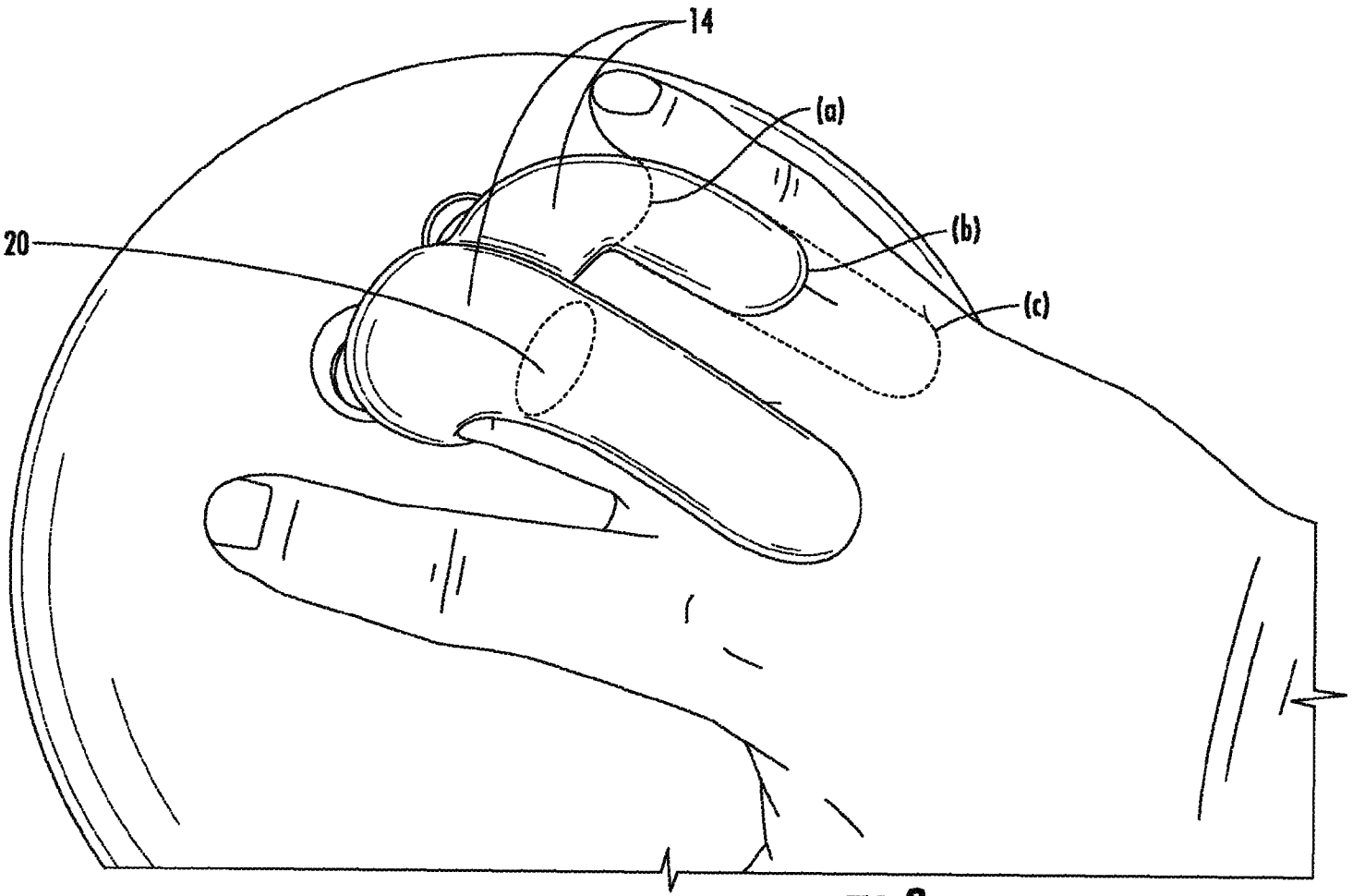
FIG. 2 is a perspective view similar to FIG. 1 showing embodiments having extended length supports and the possible position for a living hinge.
Figure 3A:
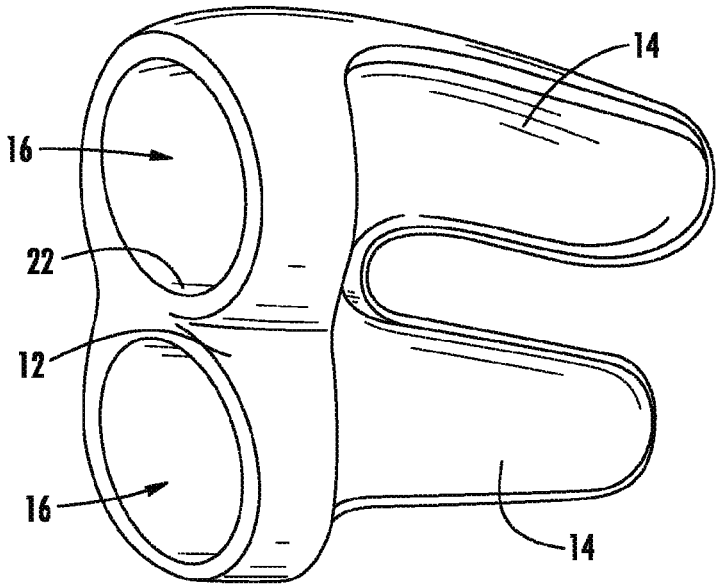
FIGS. 3*a* and 3*b* are perspective views of one-piece embodiments having substantially equal length supports (3*a*) and substantially unequal length supports (3*b*)
Figure 3B:
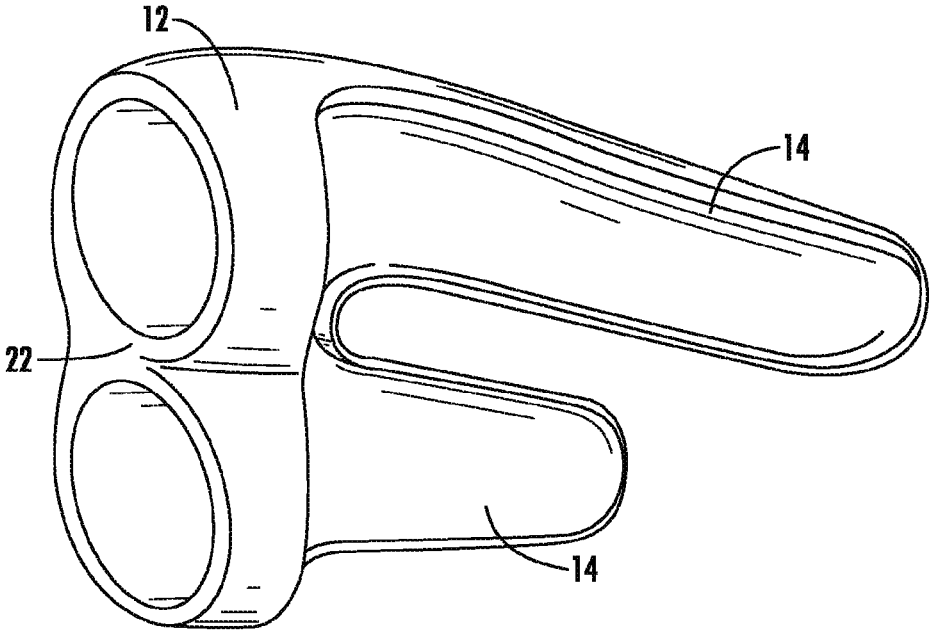
Figure 4:
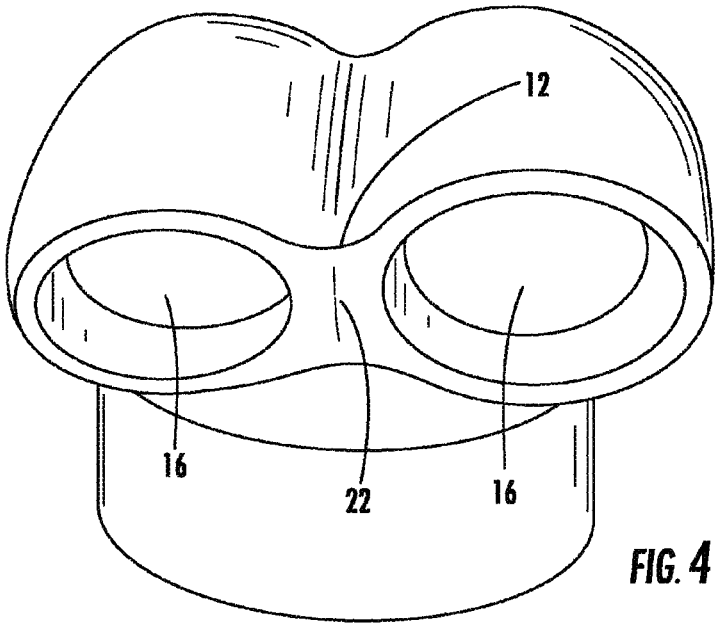
FIG. 4 is a perspective view of an embodiment showing two separate and adjacent finger collar openings.
Figure 5:
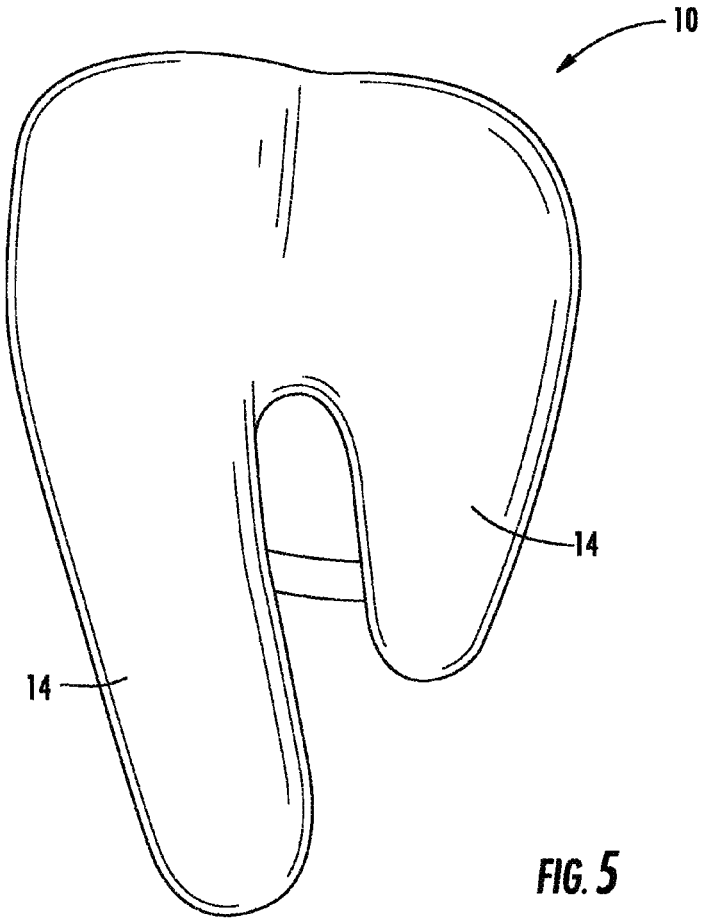
FIG. 5 is a top plan view of an embodiment similar to that shown in FIG. 3*b;*

Referring to FIGS. 1-6, one-piece molded embodiments of device 10 can be more readily understood. FIGS. 1 and 2 illustrate how device 10 is used for a bowler. Preferably, the middle and ring fingers are placed within device 10 before picking up a bowling ball. The extended supports 14, of which there are two separate and adjacent supports shown, extend to just short of the base of the user's finger. However, FIG. 2 shows in dashed lines (a, b, c) that short, medium and long supports 14 may be preferred in some applications. FIGS. 3*a*, 3*b* and 5 illustrate a similar concept.

Preferably, the supports 14 are formed rigid or include a rigid surface built into the top of device 10, to restrict the two inserted fingers from moving backwards. A bent-back finger may cause an injury and would be counter-productive and potentially debilitating for many activities. The supports 14 may be made of plastic, wood, metal or any combination of materials best suited to achieve the desired result. Potentially a thermoplastic or composite material which is able to be heated, bent and retrain its shape could provide each individual with a custom fit having more or less hook, depending on the user's preference. This type of custom bending technology is used in the sport of hockey for bending and retraining the shape of the hockey stick blade.

As shown at 20 of FIG. 2, another embodiment may include a living hinge which would be angled so as to allow the fingers to bend forward further but would not permit them to bend back past a predetermined point. Padding (not shown) or a soft textured surface may be used on the inner contact portion of the device 10, if desired.

The extended supports 14 are preferably curved, as shown. The curve is in a direction transverse to a line perpendicular to a peripheral plane of the openings. That is, the curve of the support 14 is across the central axis of the opening. The extent of the curve may depend on such factors as the activity, the length of the support relative to the user's finger, and personal preference.

With specific reference to bowling, the device 10 actually positions the fingers slightly bent forward which is more conducive to achieving a hook. This in turn provides a consistent delivery resulting in the bowler bowling more strikes. Equally important to the bowler is the ability to recreate or replicate a consistent bowling release which is critical for higher bowling scores. These capabilities are provided with the help of the present device 10.

In use, referring to FIGS. 1-4, the user's middle and ring fingers are inserted through opening 16 with the supports 14 extending toward the user's hand. In the illustrated one-piece embodiment, the device 10 consists of a common wall (divider) 22 separating two adjacent openings 16 for the fingers to be inserted through prior to the user grasping the bowling ball.

FIG. 4 best illustrates collar 12 having two separate and adjacent openings 16 defined therein. The common wall (or divider) 22 helps to properly space the fingers for the activity.

Figure 6:
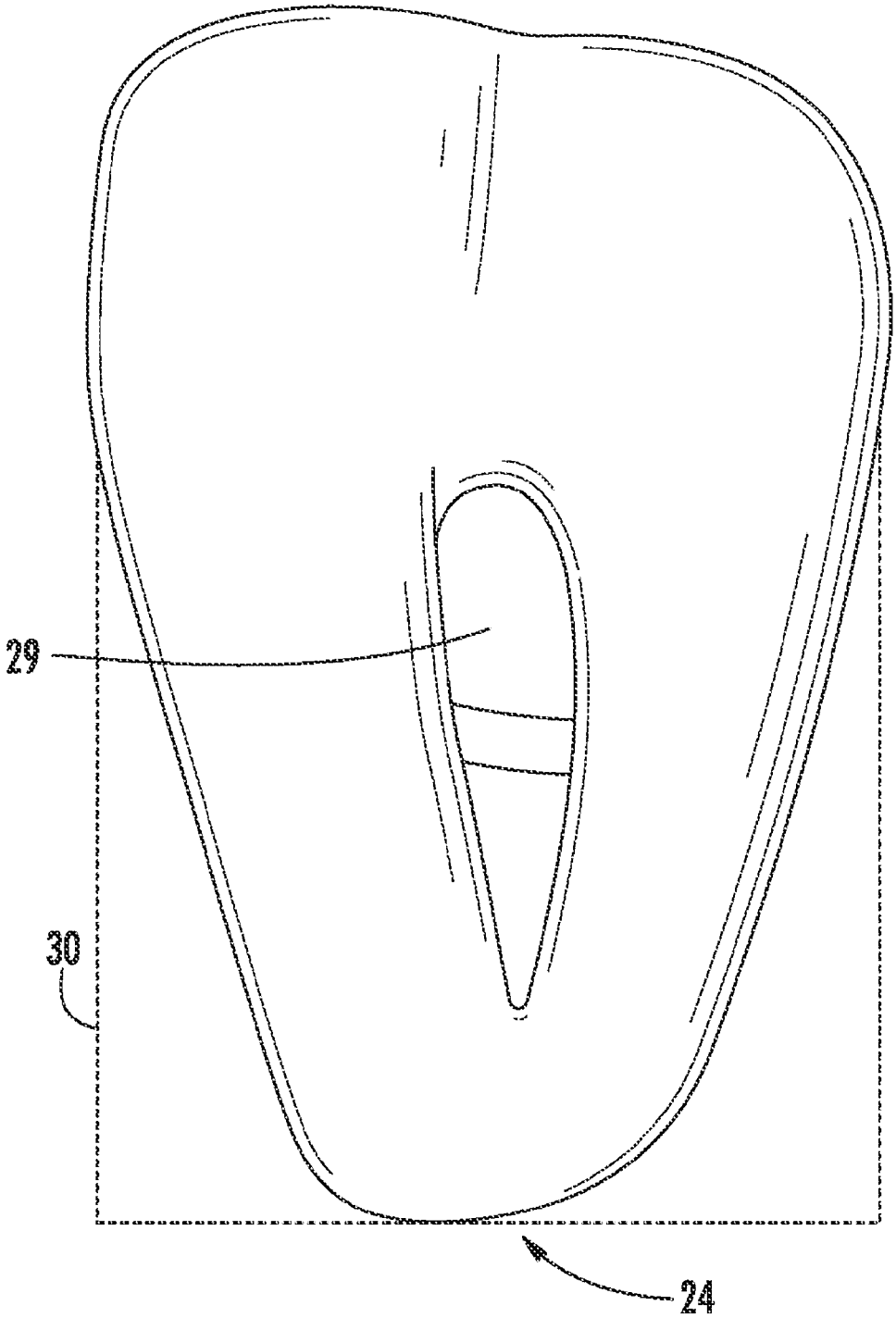
FIG. 6 is a top plan view of another embodiment showing a binding between the support ends.

A variation of the embodiments of FIGS. 1-5 is illustrated in FIG. 6. The device 10 includes adjoining the separate extended supports, preferably at the point which rests on the back of the user's hand, to form bridge structure 24. Bridge structure 24 may help displace and absorb more of the energy generated while releasing a bowling ball. Additionally, bridge structure 24 may facilitate use with other aids such as a common wrist support device (not shown). Such additional aids may be included and manufactured to accept the bridge structure 24 or as companion pieces to a preferred embodiment or part of a system.

The embodiment of FIG. 6 may also be useful when considering a universal design suitable for right or left handed bowlers. For example, the area illustrated at 29 may be comprised of a solid piece between the finger supports 14. In fact, the area within the broken line of device 10 may be one flat piece of plastic, metal, etc., which would run the length of the fingers and wrap/attach appropriately around the user's fingers as described earlier.

Figure 7:
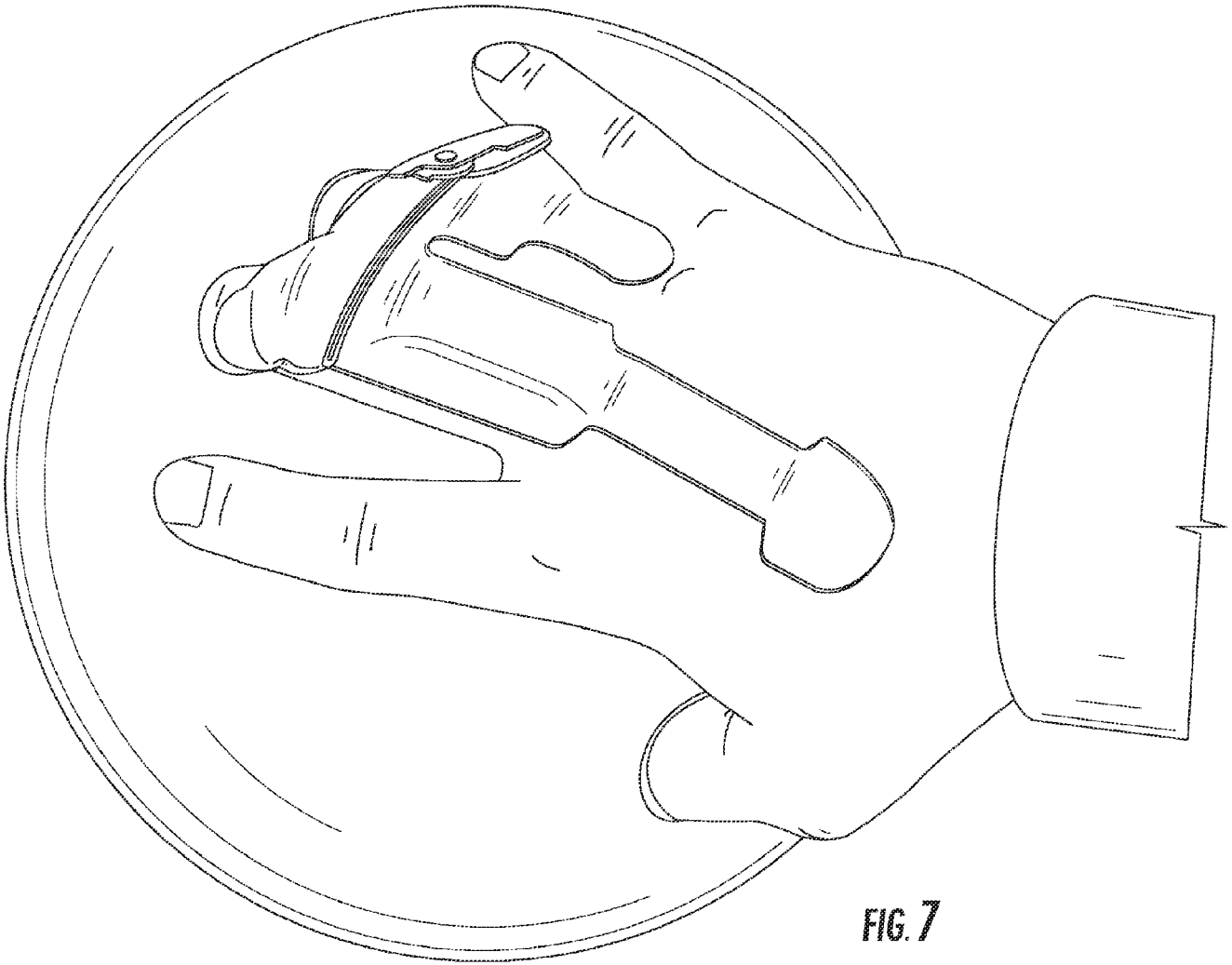
FIG. 7 is a perspective view of a metal embodiment of the device.
Figure 8:
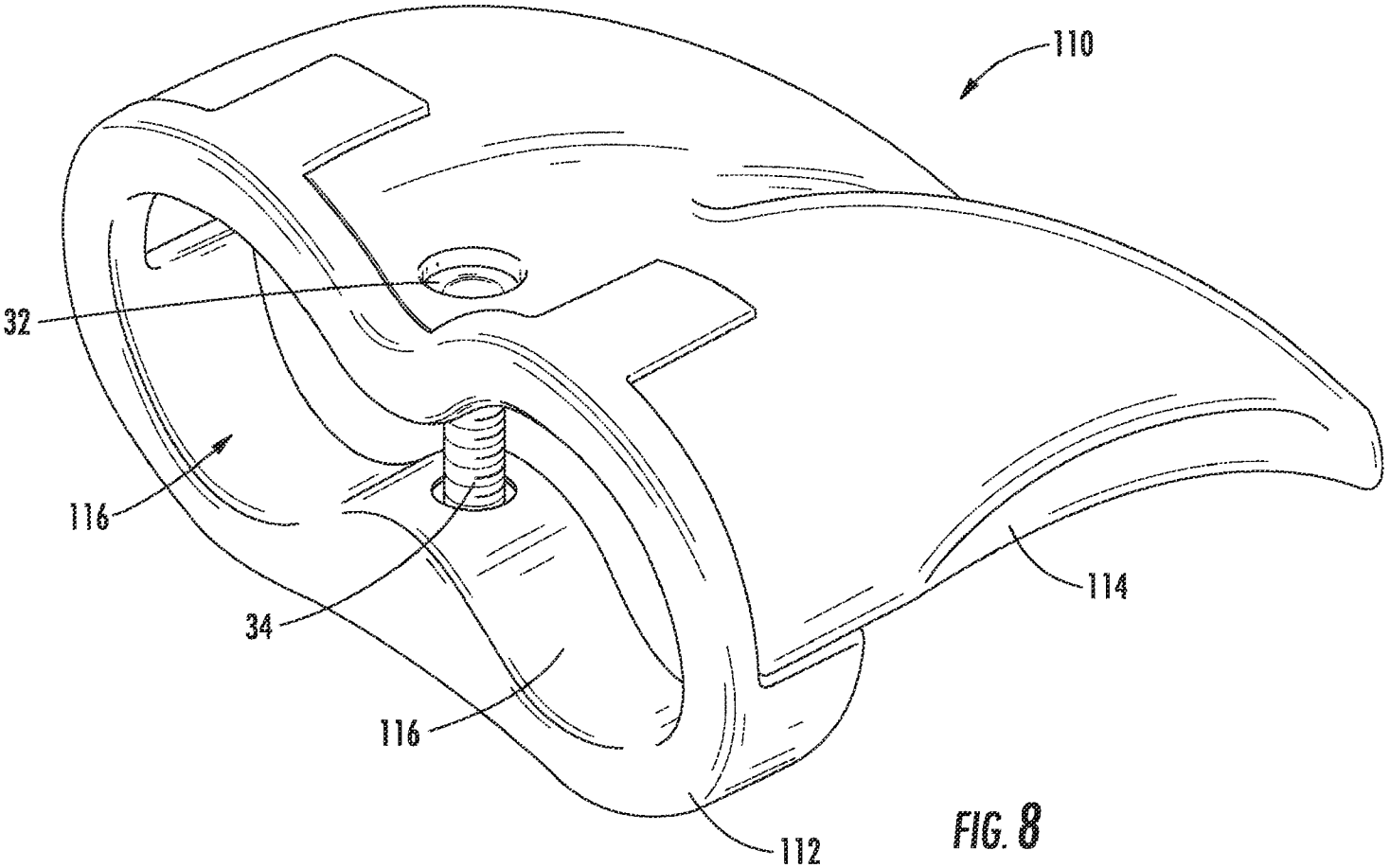
FIG. 8 is a top perspective view of a molded two-piece embodiment of the device.
Figure 9:
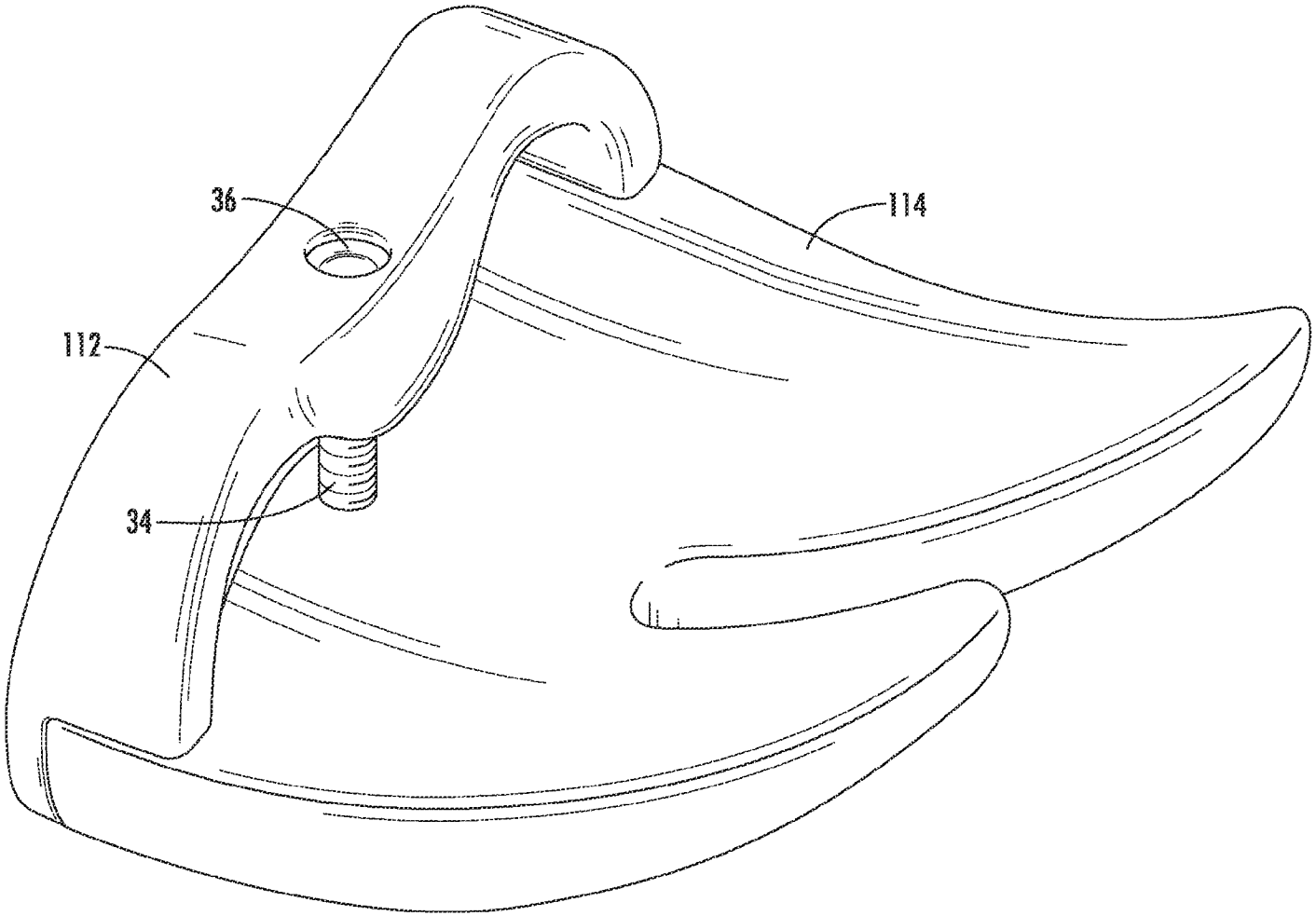
FIG. 9 is a perspective view of the underside of the embodiment of FIG. 8.
Figure 10:
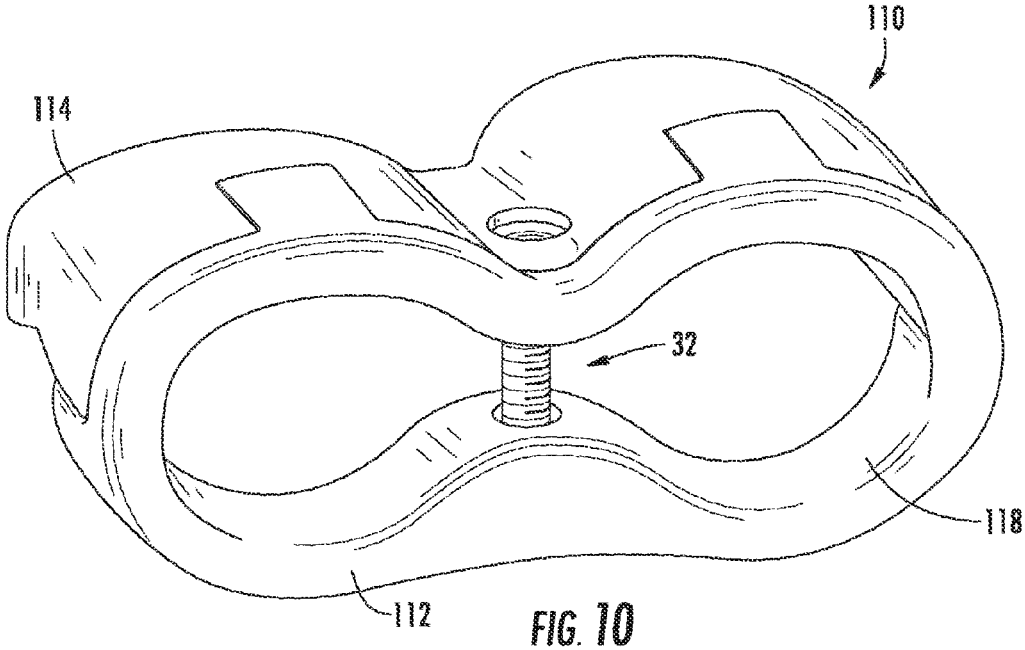
FIG. 10 is a front perspective view of the embodiment of FIG. 8.
Figure 11:
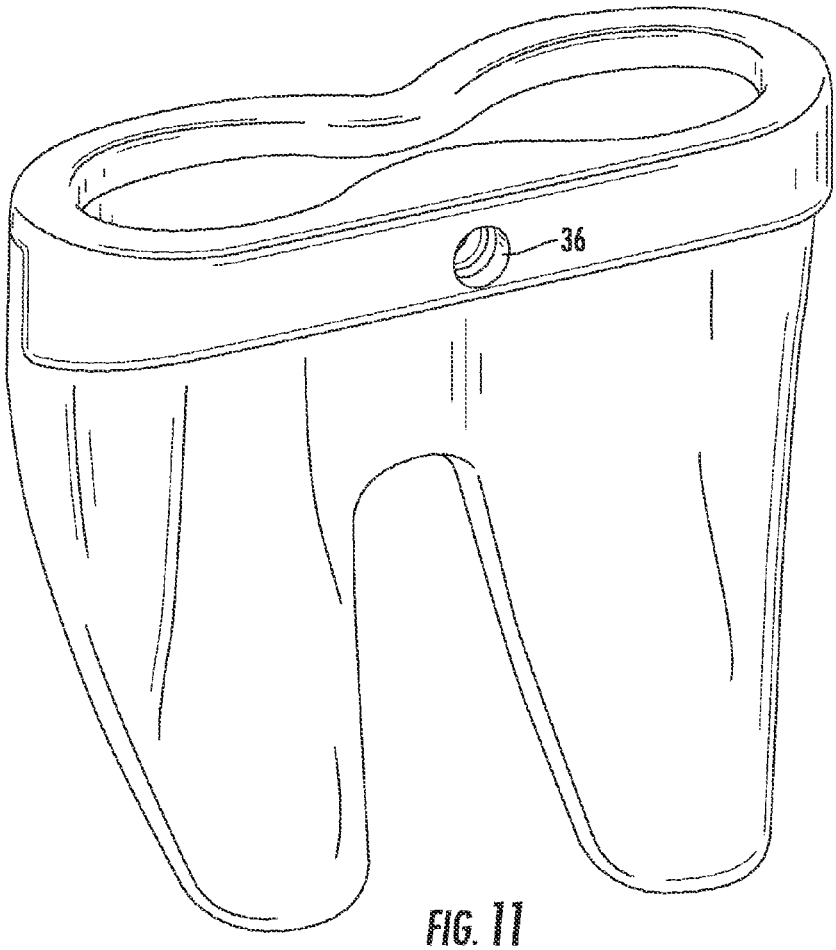
FIG. 11 is another perspective view of the underside of the embodiment of FIG. 8.
Figure 12:
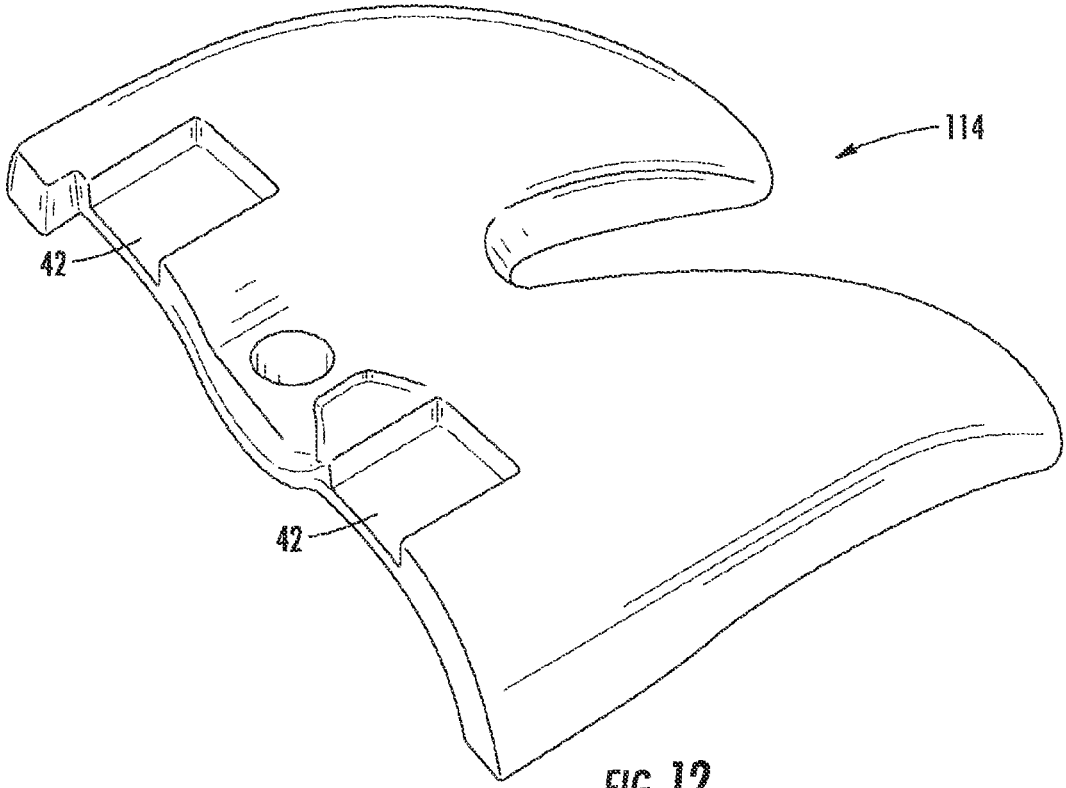
FIG. 12 is a top view of an extended support portion of the embodiment of FIG. 8.
Figure 13:
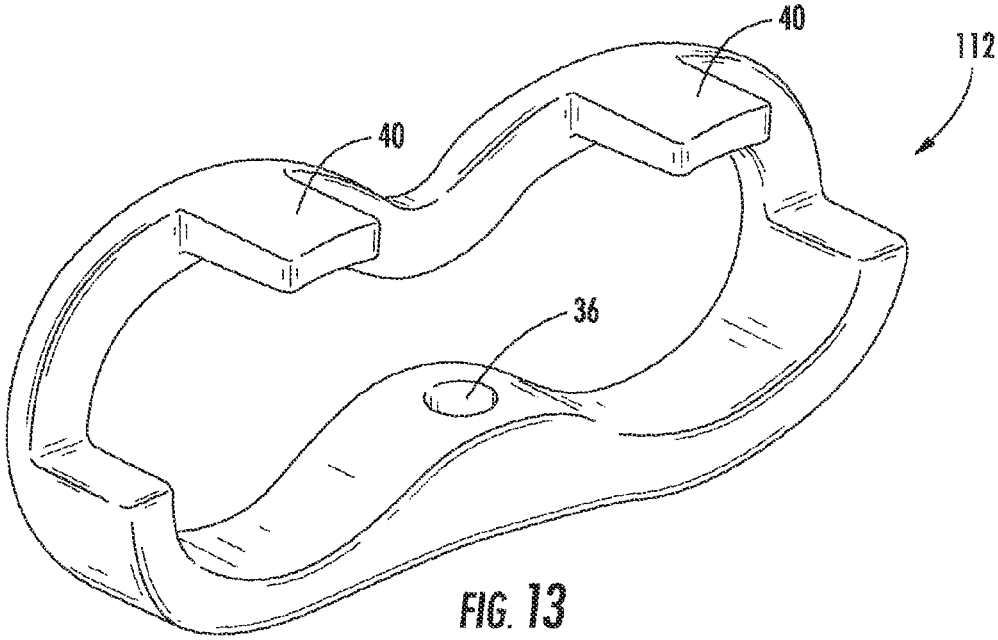
FIG. 13 is a perspective view of a finger collar portion of the embodiment of FIG. 8.
Figure 14:
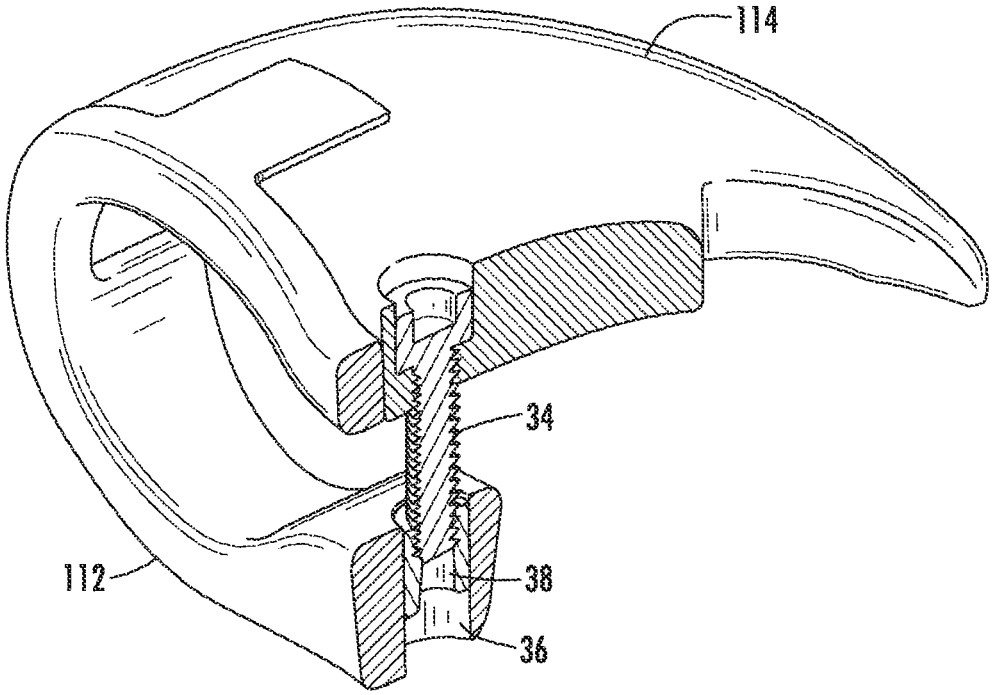
FIG. 14 is a cut-away of the embodiment of FIG. 8, showing an adjustment control.

To this point, the illustrated embodiments have been predominately constructed of a rigid polymer, one-piece design and preferably molded. With reference to FIG. 7, a metal version of device 10 is illustrated.

All of the various embodiments are preferably sized to be capable of accepting added interior padding, self-adhesive or tape (e.g., bowler's tape) to adjust the size and to add comfort. A metal embodiment could be encased in fabric, leather, or a foam material for an attractive appearance and comfortable feel.

Referring now to FIGS. 8-14, a two-piece device 110 is illustrated. In a preferred embodiment of the two-piece design, the collar 112 and extended support 114 are manufactured as separate components. The collar 112 and support 114 are then, preferably, factory welded or glued together to form device 110. The illustrated two-piece device 110 has all the advantages of the one-piece device 10, but also allows for size adjustment, as will be described below.

Alternatively, the device 110 may be sold together, but without the welding or gluing, which allows for replacement of parts, greater customization and frequent alterations—e.g., changing between longer and shorter supports 114, as desired. In such a non-welded embodiment, other connection features, such as snap and friction fits, set screws, and even material compatible adhesives, may be used to secure the components together sufficient for activity.

As shown in the drawing figures, the collar 112 of device 110 includes multiple (preferably two) openings 116, but the openings 116 are adjacent and joined. The common wall (divider) is replaced by an open space. The open space allows the use of an adjustment control 32 to change the height dimension of the openings 116. While multiple mechanisms may be used as an adjustment control, a preferred mechanism is a simple nut and bolt configuration. That is, a threaded post 34 sits within a recess on a surface of device 110, preferably within the extended support 114 component, and connects to a threaded receptacle 36 in an opposing surface of device 110, preferably within the collar 112 component. This cross connecting configuration provides stability to device 110 during activity and also holds the two components together in the alternate embodiment (i.e., non-welded components). The position of the adjustment control may be reversed, of course.

Further, the threads of the receptacle 36 may be integral to device 110 or they may be provided by a corresponding threaded nut 38 (FIG. 14) seated in a receptacle 36 of the opposing surface. The threaded receptacle 36 should be stationary such that it does not turn with the threaded post 34. Accordingly, turning the threaded post 34 at a keyed head (e.g., slotted, hex, Phillips, star, etc.) pulls the two surfaces together or moves them apart.

The adjustment of the openings 116 may be significant to allow for a wide range of finger sizes. This can be a substantial economic savings to manufacture a single (or certainly fewer) size device 110 to accommodate many more individuals.

The collar 112 is also indexed using flanges 40 to allow quick, easy and perfectly seated assembly of device 110 each time. The flanges 40 fit within recesses 42 in support component 114. Together the flanges 40 and recesses 42 help stabilize the extended supports 114 during use to prevent any twisting between the connected components. For the non-welded embodiment described above, the flanges 40 and recesses 42 may include snap-fit (or similar connecting) features to help secure the components together.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

The invention claimed is:

1. A device for providing support to a plurality of fingers of a user during an activity, the device comprising:

a collar defining a periphery of an opening for insertion of a plurality of a user's fingers;

a rigid extended support connected to the collar, wherein the support curves in a direction transverse to a line through a plane of the periphery; and, an adjustment control for changing a dimension of the opening defined by the periphery; wherein the adjustment control comprises a threaded shaft traversing the opening and a threaded receptacle positioned within the collar and engaged with the threaded shaft.

2. The device of claim 1, wherein the periphery of the opening accommodates no more than two fingers.

3. The device of claim 1, wherein the collar and support are comprised of one-piece.

4. The device of claim 1, wherein the collar and support are comprised of two separate disconnectable components.

5. The device of claim 4, wherein the rigid extended support is replaceable.

6. The device of claim 4, wherein the collar is replaceable.

7. The device of claim 1, wherein the extended support comprises at least two extensions and the device further comprises a bridge connecting ends of the at least two extensions.

8. A device for supporting a user's fingers during an activity, the device comprising:

a finger collar defining a periphery of at least one opening;

at least one rigid extended support connected to the finger collar proximate the at least one opening, wherein the support curves in a direction transverse to a line through a plane of the opening periphery; and an adjustment control for changing a dimension of the opening periphery, wherein the adjustment control comprises a threaded shaft traversing the joined openings and a threaded receptacle positioned within the collar and engaged with the threaded shaft.

9. The device of claim 8, wherein the finger collar defines a periphery of two separate and adjacent openings.

10. The device of claim 8, wherein the finger collar defines a periphery of two joined and adjacent openings.

11. The device of claim 8, wherein the collar and extended support are one-piece.

12. The device of claim 8, further comprising two separate and adjacent extended supports.

13. The device of claim 12, wherein each support has a length and the lengths are substantially equal.

14. The device of claim 12, wherein each support has a length and the length of one support is substantially greater than the length of the other support.

15. The device of claim 12, further comprising a bridge connecting ends of the two separate and adjacent supports.

* * * * *